United States Patent [19]

Takahata et al.

[11] 3,994,323

[45] Nov. 30, 1976

[54] LIQUID SUPPLYING NOZZLE

[75] Inventors: Minoru Takahata, Khofu; Yuji Fujinuma, Tokyo; Tatsuoki Saito, Yamanashi, all of Japan

[73] Assignee: Tokico Ltd., Kawasaki, Japan

[22] Filed: Jan. 6, 1975

[21] Appl. No.: 538,853

[30] Foreign Application Priority Data

Jan. 11, 1974 Japan ..... 49-6491

[52] U.S. Cl. ..... 141/302; 141/392

[51] Int. Cl.[2] ..... B65B 3/04

[58] Field of Search..... 141/1, 128, 198, 206–229, 141/346, 347, 392, 301, 302, 308

[56] References Cited

UNITED STATES PATENTS

| | | | |
|---|---|---|---|
| 2,818,889 | 1/1958 | Krause | 141/208 |
| 2,936,799 | 5/1960 | Mannon | 141/208 |

FOREIGN PATENTS OR APPLICATIONS

| | | | |
|---|---|---|---|
| 255,749 | 9/1962 | Australia | 141/208 |

*Primary Examiner*—Richard E. Aegerter
*Assistant Examiner*—Frederick R. Schmidt
*Attorney, Agent, or Firm*—Haseltine, Lake & Waters

[57] ABSTRACT

In a liquid supply nozzle having a nozzle valve opened and closed by the manipulation of an operating lever, a nozzle pipe having an air vent hole near the front discharge end thereof, and an automatic stopping mechanism operating when air supply thereto is shut off by the closure of the air vent hole to close the nozzle valve irrespective of the operation of the operating lever, there is provided a mechanism which normally keeps the air vent hole open but operates when the nozzle is pressed against the rim of a liquid filling inlet designed for supplying a liquid of a kind other than that of the liquid specified for the nozzle to close the air vent hole. As a result of the closure of the air vent hole by this vent hole closing mechanism, the nozzle valve is closed by the automatic fuel supply stopping mechanism even when the operating lever is operated, whereby supplying of the specified liquid into a liquid filling inlet designed for another kind of liquid is effectively prevented.

7 Claims, 8 Drawing Figures

FIG. 3
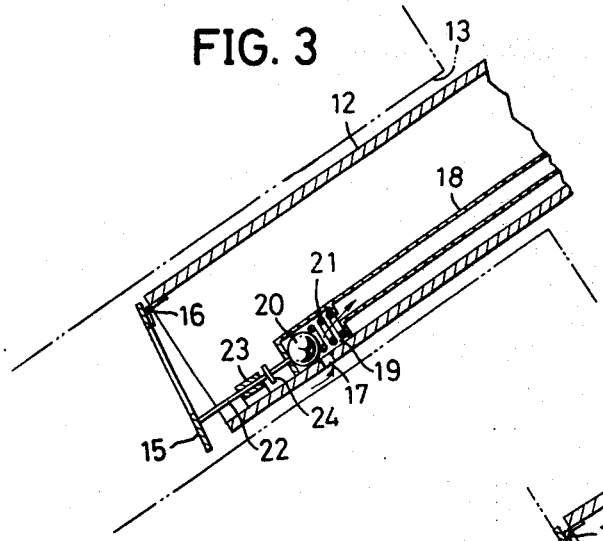
FIG. 4
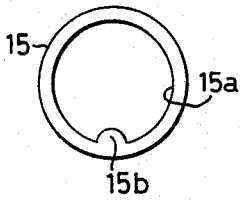
FIG. 5
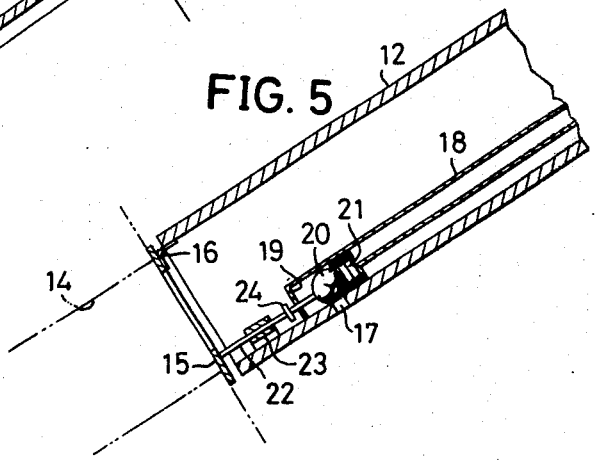
FIG. 6
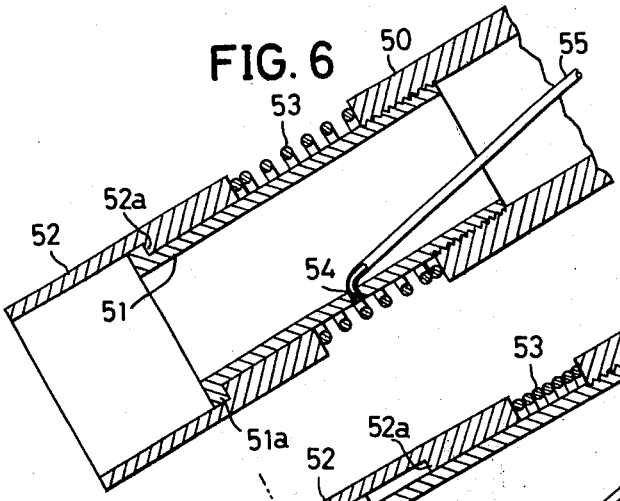
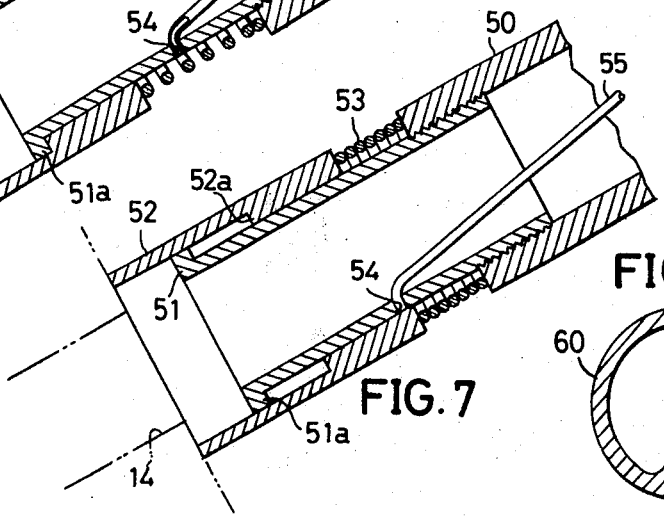
FIG. 7
FIG. 8
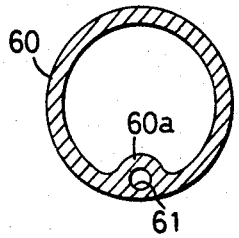

LIQUID SUPPLYING NOZZLE

BACKGROUND OF THE INVENTION

This invention relates generally to a liquid supplying nozzle and more particularly to a liquid supplying nozzle which is so adapted that it can supply a liquid of a specific kind into only a specific liquid filling inlet and cannot supply the liquid into a liquid filling inlet for other kinds of liquids.

Heretofore, as a gasoline (petrol) for motor vehicle use, lead containing or adding gasoline, prepared by adding tetraethyllead to gasoline to increase the octane number thereof, has been used. However, in the exhaust gas of an engine which uses this lead containing gasoline, lead compounds are present and become one cause of atmospheric pollution.

Lately, environmental impairment, particularly atmospheric pollution is becoming a serious problem, and there is a trend toward the obligatory use of gasoline not containing lead compounds, that is, leadless gasoline, instead of lead containing gasoline.

However, in the period of transition during which the vehicles using lead containing gasoline are totally replaced by vehicles using leadless gasoline, these two kinds of vehicles will coexist. Accordingly, during this period, it is necessary to prevent the supplying of lead containing gasoline into the fuel tanks of vehicles using leadless gasoline in order to minimize atmospheric pollution.

One measure which would appear to be suitable for solving this problem is simply to make the diameters of the fuel tank inlets and refueling nozzles for leadless gasoline smaller than those for lead containing gasoline thereby to prevent nozzles for lead containing gasoline being inserted into the fuel tank inlets for leadless gasoline. A conventional refueling nozzle, however, is adapted to discharge gasoline when the operating lever is squeezed irrespectively of whether or not the nozzle end is in a state of insertion in a fuel tank inlet. For this reason, it is quite possible to foresee the case where an operator intentionally squeezes the operating lever of a nozzle for lead containing gasoline with the nozzle tip pressed against the inlet of a fuel tank for leadless gasoline thereby to forcibly and deliberately fill the tank with lead containing gasoline. It can be foreseen that such a procedure will be apt to occur particularly in cases where self-service is practiced in a fuel filling station.

Accordingly, it is desirable that a refueling nozzle for lead containing gasoline be so adapted that it is not merely prevented from being inserted into a fuel tank inlet for leadless gasoline but is prevented also from supplying gasoline therethrough.

Furthermore, there is also a need for a device which, in addition to differentiating between leadless gasoline and lead containing gasoline as described above, is capable of preventing erroneous refueling with different kinds of liquids such as, for example, gasoline and light oil.

SUMMARY OF THE INVENTION

Accordingly, it is a general object of the present invention to provide a novel and useful liquid supplying nozzle which fulfills the above stated requirements.

A specific object of the invention is to provide a liquid supplying nozzle for supplying a specific kind of liquid which is so adapted that is cannot supply that liquid into a liquid supplying inlet for another specific kind of liquid, one example thereof being a nozzle for supplying lead containing gasoline with respect to a refueling inlet for leadless gasoline.

Another object of the invention is to provide a liquid supplying nozzle having a nozzle tip which cannot be inserted into a supply inlet into which a liquid other than that of a specific kind must not be introduced and, moreover, so adapted that it cannot supply liquid into that supply inlet even when the operating lever thereof is squeezed.

Still another object of the invention is to provide a liquid supplying nozzle having in the vicinity of its nozzle tip a vent hole for introducing air, the liquid supplying operation of the nozzle being automatically stopped by the closing of this vent hole by the supplied liquid, in which nozzle, the air vent hole is closed when the nozzle tip is placed in contact with and pressed against a liquid supply inlet for a specific liquid differing from the liquid for which the nozzle is designed, whereby the nozzle is unable to supply its liquid.

Further objects and features of the invention will be apparent from the following detailed description with respect to preferred embodiments of the invention when read in conjunction with accompanying drawings.

BRIEF DESCRIPTION OF THE DRAWINGS

In the drawings:

FIG. 3 is a side view, in longitudinal section, showing the discharge end part constituting an essential part of the liquid supplying nozzle shown in FIG. 1;

FIG. 4 is a front view of a ring of the forward end part illustrated in FIG. 3;

FIG. 5 is a side view, in longitudinal section, showing the discharge end part of the same nozzle in a state wherein it is abutting against a liquid filling inlet for a different liquid;

FIG. 6 is a side view, in longitudinal section, of an essential part of another embodiment of the liquid supplying nozzle of the invention;

FIG. 7 is a side view, similar to FIG. 6 showing the same nozzle in a state wherein the discharge end of its nozzle pipe is abutted against a fuel filling inlet for leadless gasoline; and FIG. 8 is a cross section of another embodiment of a nozzle pipe of the nozzle of the invention.

DETAILED DESCRIPTION

Figure 1:
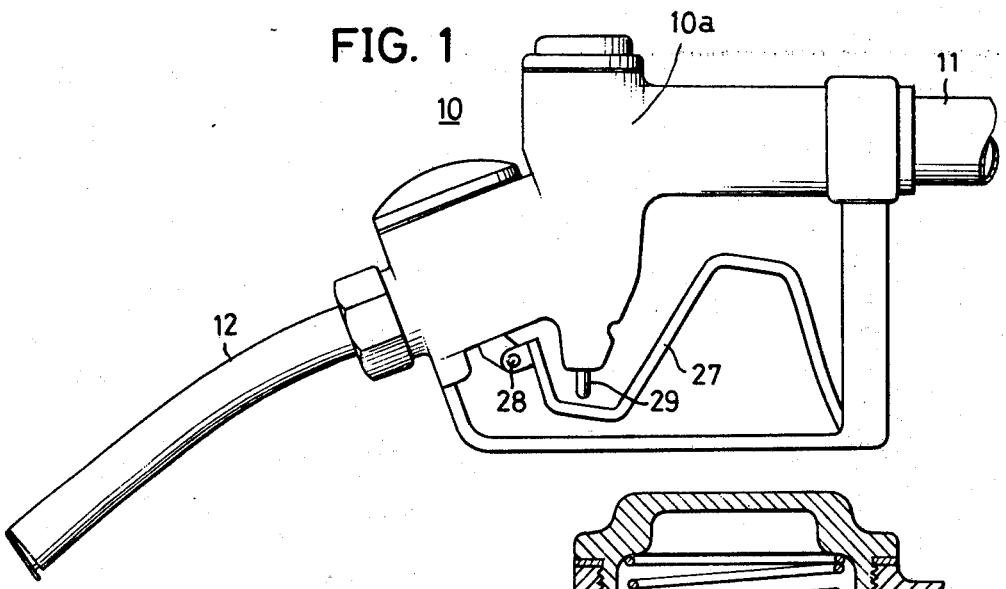
FIG. 1 is a side view of one embodiment of a liquid supplying nozzle according to the invention.
Figure 2:
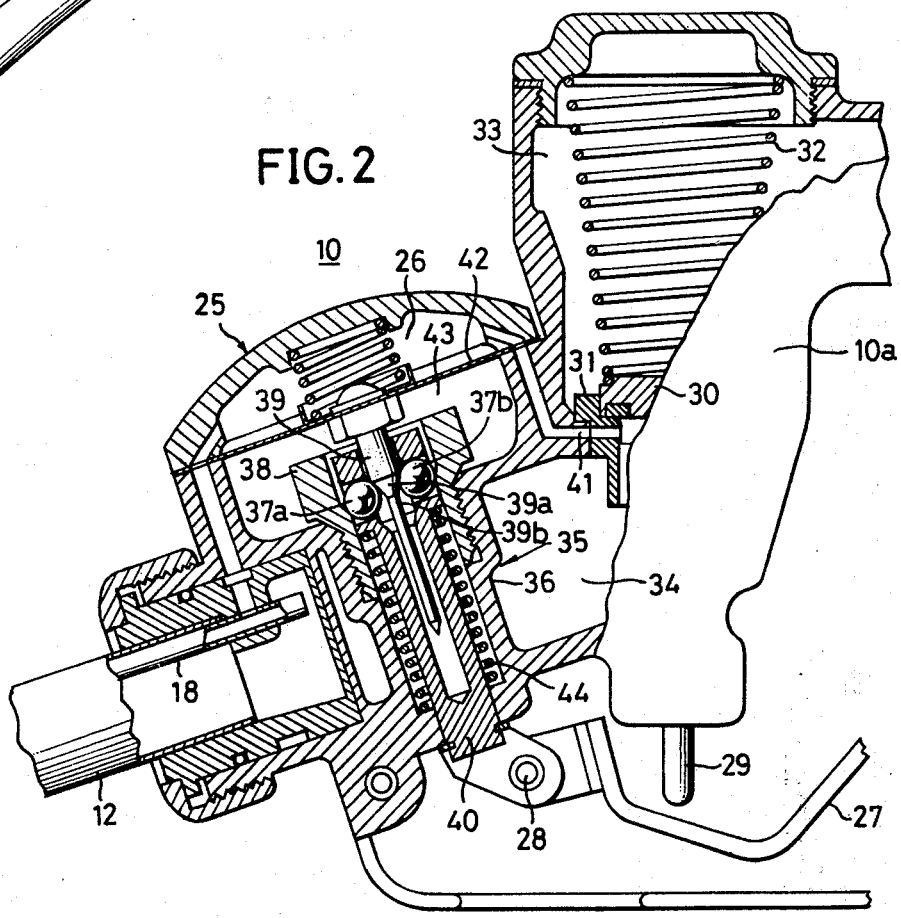
FIG. 2 is a relatively enlarged side view, with some parts shown in vertical section, of a valve mechanism of the nozzle shown in FIG. 1.

Referring first to FIGS. 1 through 4, a first embodiment of the liquid supplying nozzle according to the invention will be described. The nozzle part illustrated in FIG. 2 is substantially the same as the corresponding part of a known liquid supplying nozzle.

This liquid supplying nozzle generally designated by reference numeral 10 is, for example, a fuel supplying nozzle for lead containing gasoline and is connected at its rear end to the outer or downstream end of a fuel hose 11 for supplying lead containing gasoline. This liquid supplying nozzle 10 has a body structure **10*a* housing valve mechanisms as described hereinafter and provided with an operating lever 27 and a nozzle pipe 12** connected to the front end of the body structure 10*a*. The nozzle pipe 12 has an outer diameter which is less than the inner diameter of the refueling inlet 13 for lead containing gasoline of a vehicle using lead containing gasoline as shown in FIG. 3, and which is greater than the inner diameter of a leadless gasoline refueling inlet 14 of a vehicle using leadless gasoline as shown in FIG. 5.

At the extremity or discharge end of the nozzle pipe 12, there is provided a ring 15 having an opening 15*a* and an inwardly projecting lug 15*b* as shown in FIG. 4 and hinged at its upper part to the upper rim of the end of the nozzle pipe 12 by a pivot pin 16. An air vent hole 17 for introducing air is formed through the lower part of the wall of nozzle pipe 12 at a position in the vicinity of the discharge thereof. An air vent pipe 18 communicating at its forward end to the air vent hole 17 extends rearward through the interior of the nozzle pipe 12.

The air vent pipe 18 has at its forward end a valve box 19, within which a ball 20 is displaceably installed. This ball 20, which can function as a ball valve, is continually urged by the force of a spring 21 toward a forward end part of the valve box 19 and, in normal state, is pressed against this forward end part as indicated in FIG. 3, in which position the ball 20 is clear of the vent hole 17, which is thereby in open state.

Within the nozzle pipe 12 at its end part forward of the valve box 19, a push rod 22 is slidably supported by a guide member 23 in an axial direction substantially parallel to the axis of the nozzle pipe 12. The forward end of this push rod 22 normally extends forward, beyond the front end of the nozzle pipe 12 and is abutting against the above mentioned lug 15*b* of the ring 15, while the rear end of the push rod 22, passing through a hole in the forward end part of the valve box 19 is abutting against the ball 20. The push rod 22 is provided with a flange 24 fixed thereto and is thereby limited in forwardly thrusting movement.

The rear end of the above mentioned air vent pipe 18 communicates with a diaphragm chamber 26 of a valve mechanism section 25 of the body structure 10*a* as shown in FIG. 2.

The operation of refueling with lead containing gasoline by inserting the end of the nozzle pipe 12 of the fuel supplying nozzle 10 for lead containing gasoline as described above into a fuel filling inlet 13 for lead containing gasoline will now be described together with details of the operating parts of the nozzle.

When fuel is to be discharged through the nozzle 10, the aforementioned operating lever 27 is squeezed and thereby rotated in the counterclockwise direction, as viewed from the side as in FIG. 1, about a pivot pin 28. The lever 27 thereby pushes upward a valve stem 29 fixed to and extending downward from a valve structure 30, which is thereby pushed upward counter to the force of a spring 32 and separates from its valve seat 31. The valve seat 31 is disposed on a partition wall part formed integrally with and within the nozzle body structure 10*a* and encompasses a through opening in this partition wall part, which separates a chamber 33 communicating with the aforementioned fuel hose 11 from a chamber 34 communicating with the rear end of the nozzle pipe 12.

When the valve structure 30 thus separates from its valve seat 31, gasoline supplied into the chamber 33 through the fuel hose 11 is permitted to flow into the chamber 34 and, passing around the exterior of a cylindrical part 36 accommodating an automatic fuel supply stopping valve mechanism 35 described hereinafter and through the nozzle pipe 12, flows through the discharge end thereof and the opening 15*a* of the ring 15. The gasoline is thus supplied into the fuel filling inlet 13 of the fuel tank (not shown) of a vehicle.

At the time when the operating lever 27 is squeezed as described hereinabove, balls 37*a* and 37*b* provided within the stop valve mechanism 35 are interposed between a concave tapered surface of a ball retainer 38 and a convex tapered surface 39*a* of a rod 39, thereby obstructing descending movement of a hollow stem 40 holding these balls 37*a* and 37*b*.

The aforementioned diaphragm chamber 26, which is formed on one side of a diaphragm 42 fixed at its center to the upper end of the rod 39, communicates through a passage hole 41 to a venturi-like constriction in the aforementioned through opening below the valve seat 31. Consequently, while the fuel is being discharged for refueling as described above, the air within the diaphragm chamber 26 is being sucked by the venturi action due to the flow of fuel. However, since the diaphragm chamber 26 is normally communicating with the atmosphere by way of the vent pipe 18 and the air vent inlet 17, the pressure within the diaphragm chamber 26 does not become negative, and the diaphragm 42 is not deflected.

When the above mentioned fuel tank being refueled becomes full, the liquid surface of the fuel rises within the fuel filling inlet 13 until, eventually, it closes the air vent hole 17 provided in the nozzle pipe 12, thereby shutting off the supply of air to the diaphragm chamber 26 by way of the vent hole 17 and vent pipe 18. Since, on one hand, air is being sucked through the passage hole 41, the pressure within the diaphragm chamber 26 becomes negative.

Since air at atmospheric pressure is sealed in within a chamber 43 on the side of the diaphragm 42 opposite the side of the diaphragm chamber 26, the diaphragm 42 at this time deflects toward the chamber 26, whereby the above mentioned rod 39 fixed to the diaphragm 42 also undergoes upward displacement. Consequently, a small diameter part of the tapered surface 39*a* of the rod 39 or a small diameter part 39*b* of the rod 39 is brought into a position to confront the balls 37*a* and 37*b*. As a consequence, the balls 37*a* and 37*b* are separate from the tapered surface of the ball retainer 38 and move toward each other thereby to permit the stem 40 to descend.

The lower end of the hollow stem 40 supports a bracket which, in turn, supports the aforementioned pivot pin 28 about which the operating lever 27 rotates. A spring 44 continually imparts an upward force to the upper part of the stem 40. Since the force of the aforementioned spring 32 urging the valve stem 29 downward is greater than the force of the spring 44 urging the stem 40 upward, the stem 40 is forced downward, and at the same time the valve stem 29 also descends until the valve structure 30 is seated on its valve seat 31 thereby to close the valve mechanism. Thereafter, when the operating lever 27 is released, the valve stem 29 remains in its lowest position, while the hollow stem 40 is raised by the force of the spring 44, and the balls 37*a* and 37*b* also return to their original positions. Furthermore, the operating levers 27 also returns to its original, inoperative position.

Thus, in the case where the nozzle pipe 12 of the fuel supplying nozzle 10 is inserted into a large diameter fuel filling inlet 13 for lead containing gasoline, ordinary refueling and automatic stopping of the refueling are carried out by the manipulation of the operation lever 27 similarly as in the prior art.

Next, the operation in the case where refueling of a fuel filling inlet for leadless gasoline is attempted with the above described fuel supplying nozzle 10, intentionally or by error, will be considered.

As indicated in FIG. 5, a fuel filling inlet 14 for leadless gasoline is made with an inner diameter which is less than the outer diameter of the nozzle pipe 12 of the fuel supplying nozzle 10 for lead containing gasoline. For this reason, the nozzle pipe 12 cannot be inserted into the inlet 14, and the ring 15 is brought against the rim part of the inlet 14 and is swung about the pivot pin 16 toward the front end face of the nozzle pipe 12.

As a result of this swinging movement of the ring 15, the lug 15*b* thereof pushes the push rod 22 inward thereby to push the ball 20 rearward against the force of the spring 21 until the ball 20 covers and closes the air vent hole 17.

Accordingly, even if the operating lever 27 is squeezed at this time to open the valve 30 for refueling, the diaphragm chamber 26 will immediately be subjected to negative pressure as the gasoline starts to flow since air is prevented from being supplied by way of the vent hole 17 and vent pipe 18 to the diaphragm chamber 26. Consequently, the diaphragm 42 and the rod 39 will move upward, and the valve structure 30 will immediately close similarly as in the above described automatic operation of stopping the refueling. As a result, refueling will become practically impossible, and the supplying of lead containing gasoline into the filling inlet 14 for leadless gasoline will be positively prevented.

When the nozzle pipe 12 is separated from the filling inlet 14, the ball 20, the push rod 22, and the ring 15 are returned to their original states as indicated in FIG. 3 by the force of the spring 21, and the air vent hole 17, which has been closed by the ball 20 is again opened.

In a second embodiment of the fuel supplying nozzle according to the invention as illustrated in FIG. 6, a guide cylinder 51 is screwed at its rear end into the forward end of a nozzle pipe main structure 50. The guide cylinder 51 has a stepped flange 51*a* at its forward end. A cylindrical member 52 is fitted on and around the outer cylindrical surface of the forward part of the guide cylinder 51 in a manner permitting it to slide on the guide cylinder 51 coaxially relative to the guide cylinder 51 and nozzle pipe main structure 50, the rear end of this cylindrical member 52 being separated by certain space from the front end of the main structure 50 of the nozzle pipe. A stepped shoulder 52*a* for engaging with the flange 51*a* of the guide cylinder 51 is formed in the inner wall surface of the cylindrical member 52. Engagement of this shoulder 52*a* with the flange 51*a* prevents the cylindrical member 52 from being pushed off the front end of the guide cylinder 51. In the above mentioned space between the member 52 and the main structure 50 of the nozzle pipe, there is provided a spring 53, by which the member 52 is continually urged forward, i.e., in the direction for engagement of the shoulder 52*a* with the flange 51*a*.

The guide cylinder 51 is provided with an air vent hole 54 formed through its cylindrical wall at a part thereof surrounded by the above mentioned space between the member 52 and the main structure 50. The cylindrical member 52 is normally held in the position indicated in FIG. 6 by the spring 53, and the air vent hole 54 is open and communicating with the atmosphere. This air vent hole 54 communicates with the interior of an air vent pipe 55, which extends rearward through the nozzle pipe main structure 50 from the vent hole 54. The air vent pipe 55 at its rear end communicates with a diaphragm chamber 26 similarly as the air vent pipe 18 shown in FIG. 2.

In the case of refueling into a fuel filling inlet for lead containing gasoline with a fuel supply nozzle of the above described construction, since the inner diameter of this fuel filling inlet for lead containing gasoline is made greater than the outer diameter of the cylindrical member 52 and the nozzle pipe 50, it is possible to insert the member 52 and the nozzle pipe 50 into the fuel filling inlet and to carry out refueling and automatic stopping in the same manner as was described hereinabove with respect to the first embodiment.

The case where an attempt is made to refuel through a fuel filling inlet for leadless gasoline with the fuel supplying nozzle of this second embodiment will now be considered. The inner diameter of the fuel filling inlet 14 for leadless gasoline is made less than the outer diameter of the cylindrical member 52 as indicated in FIG. 7. For this reason, the nozzle cannot be inserted into this filling inlet 14, the member 52 thereby being pressed against the rim of the inlet 14. The force with which the nozzle is thus pressed against the filling inlet 14 overcomes the force of the spring 53, and the cylindrical member 52 slides rearward over the guide cylinder 51 toward the nozzle pipe main structure 50 until the rear part of this member 52 covers and closes the air vent hole 54.

Consequently, the supply of air to the diaphragm chamber of the automatic stopping mechanism is shut off in the same manner as in the case where air vent hole 17 is closed by the ball 20 in the preceding first embodiment. Thus, refueling becomes practically impossible.

When the cylindrical member 52 is separated from the filling inlet 14, the force of the spring 53 causes the cylindrical member 52 to slide forward over the guide cylindrical 51 and return to its original state indicated in FIG. 6, whereby the air vent hole 54, which has been covered and closed by the cylindrical member 52, is uncovered and opened to the atmosphere.

In the above described embodiments, the air vent pipes 18 and 55 are provided as structures separate from the nozzle pipes 12 and 50 and extend through the interior of the nozzle pipes 12 and 50, but the arrangement of the air vent pipe need not be so limited. That is, for example, a relatively thick wall part 60*a* can be provided to extend in the longitudinal in one part of the wall of a nozzle pipe 60, and an air vent passage hole 61 can be formed through this part 60*a*.

Furthermore, it should be understood that the present invention is not limited to the above described embodiments but can be practiced in a number of other modified forms without departing from the spirit of the invention, a requisite feature thereof being that the liquid supplying nozzle is so adapted that, when an attempt is made to supply a certain liquid specified for this nozzle with this nozzle into a fuel filling inlet designed for a different kind of liquid, the air vent hole as described above is closed by the action of pressing the nozzle against the rim of the fuel filling inlet.

What is claimed is:

1. A liquid supplying nozzle comprising:

a valve closed and opened by actuation of an operating lever;

a nozzle pipe for discharging from a front end thereof a predetermined liquid corresponding to said nozzle and passing through said valve;

air vent means having an air vent hole in said nozzle pipe normally open to the atmosphere and air vent passage means communicating with said vent hole;

an automatic stopping mechanism normally supplied with venting air via said air vent hole and passage means and operating upon shutting off of supply of said venting air to close automatically said valve and thereby to stop the supply of the liquid;

air vent hole closing means supported on said nozzle pipe for permitting displacements thereof relative to said nozzle pipe; and means for normally biasing said air vent hole closing means in a state wherein it is not closing the air vent hole, said air vent hole closing means having a dimension smaller than a diameter of a first liquid filling inlet to be supplied with a liquid of a kind specified for the nozzle and larger than a diameter of a second liquid filling inlet to be supplied with a liquid of a kind different from the kind specified for the nozzle, said air vent hole closing means being displaced against a force of the biasing means, when the nozzle pipe carrying said air vent hole closing means is pressed against said second liquid filling inlet, resulting in that the air vent hole closing means being relatively pushed by a periphery of said second liquid filling inlet, whereby the air vent hole closing means closes the air vent hole.

2. A liquid supplying nozzle as claimed in claim 1, wherein said nozzle pipe has an outer diameter which is less than the inner diameter of the first liquid filling inlet, whereby the nozzle pipe can be inserted into said first liquid filling inlet, and the second liquid filling inlet has an inner diameter smaller than the outer diameter of the nozzle pipe, whereby the nozzle pipe cannot be inserted into said second liquid filling inlet.

3. A liquid supplying nozzle as claimed in claim 1 wherein said vent hole closing means comprises an air vent hole closing member between the air vent hole and the air vent passage means, and an actuating mechanism operable when a part thereof is pressed against said second liquid filling inlet to push the air vent hole closing member against the force of the biasing means to a position for closing the air vent hole.

4. A liquid supplying nozzle as claimed in claim 3 wherein said actuating mechanism comprises a ring-shaped displacement member undergoing displacement upon being pressed against a part of said second liquid filling inlet and a push rod abutting at one end thereof against said displacement member and pushed thereby to move the vent hole closing member to said position for closing the air vent hole.

5. A liquid supplying nozzle as claimed in claim 4 wherein said air vent hole closing member is a ball, said biasing means being a spring, and including a valve box accommodating said spring and said ball.

6. A liquid supplying nozzle as claimed in claim 1 wherein said first liquid filling inlet is to be supplied with lead containing gasoline, and said second liquid filling inlet is to be supplied with leadless gasoline.

7. A liquid supplying nozzle as claimed in claim 1 wherein said air vent hole closing means comprises an air vent hole closing member of cylindrical structure formed separately from a main structure of the nozzle and supported in a manner to be spaced apart from and to be slidable relative to said main structure; a cylindrical guide member for guiding along the outer cylindrical surface thereof said cylindrical structure in translational sliding displacement along the axis of said main structure of the nozzle pipe; said biasing means comprising a spring for exerting a spring force continually urging said cylindrical structure in the axial direction away from said main structure; said air vent hole being formed in said cylindrical guide member and adapted to be opened and closed in accordance with the sliding displacement of the cylindrical structure.

* * * * *